US009937616B2

(12) United States Patent
Williams

(10) Patent No.: US 9,937,616 B2
(45) Date of Patent: Apr. 10, 2018

(54) PRECISION MARKING SYSTEM

(71) Applicant: Lenworth Williams, Brooklyn, NY (US)

(72) Inventor: Lenworth Williams, Brooklyn, NY (US)

( * ) Notice: Subject to any disclaimer, the term of this patent is extended or adjusted under 35 U.S.C. 154(b) by 122 days.

(21) Appl. No.: 15/011,645

(22) Filed: Jan. 31, 2016

(65) Prior Publication Data

US 2016/0221180 A1 Aug. 4, 2016

Related U.S. Application Data

(60) Provisional application No. 62/110,506, filed on Jan. 31, 2015, provisional application No. 62/110,513, filed on Jan. 31, 2015.

(51) Int. Cl.
*B25H 7/04* (2006.01)
*B43K 24/10* (2006.01)
*B43K 8/02* (2006.01)

(52) U.S. Cl.
CPC ..... *B25H 7/04* (2013.01); *B43K 8/024* (2013.01); *B43K 24/10* (2013.01)

(58) Field of Classification Search
CPC . B43K 8/02; B43K 8/00; B43K 24/10; B25H 7/00; B25H 7/04
USPC ..... 33/669, 578
See application file for complete search history.

(56) References Cited

U.S. PATENT DOCUMENTS 3,157,950 A * 11/1964 Duncan ..... B43L 13/12 33/41.4
3,331,135 A * 7/1967 Urish ..... D06H 1/00 33/576
4,815,212 A * 3/1989 Wood ..... B43K 27/00 33/18.1
5,323,542 A * 6/1994 Walzer ..... A41H 25/00 33/575
5,899,142 A * 5/1999 Suda ..... B41K 1/02 101/125
6,178,655 B1 * 1/2001 Potter ..... B25H 7/04 33/42
6,470,585 B2 * 10/2002 Barr ..... B25H 7/02 33/528
6,952,887 B2 * 10/2005 Muchnik ..... B25H 7/045 33/613
2001/0027612 A1 * 10/2001 Barr ..... B25H 7/02 33/528
2014/0317943 A1 * 10/2014 DeMartinis ..... G01B 3/1084 33/668
2015/0354934 A1 * 12/2015 Schneider ..... G01B 3/1084 33/760
2016/0221180 A1 * 8/2016 Williams ..... B25H 7/04

* cited by examiner

*Primary Examiner* — Yaritza Guadalupe-McCall
(74) *Attorney, Agent, or Firm* — Dunlap Bennett & Ludwig PLLC

(57) ABSTRACT

A precision marking system for precisely marking at least one mark is provided. The precision marking system embodies at least one precision spot pen and a cooperating precision template, when used together repeatedly enable the precise creation and re-creation of spaced-apart marks along a particular workpiece at desired or standardized intervals.

6 Claims, 5 Drawing Sheets

Fig. 7
Fig. 8
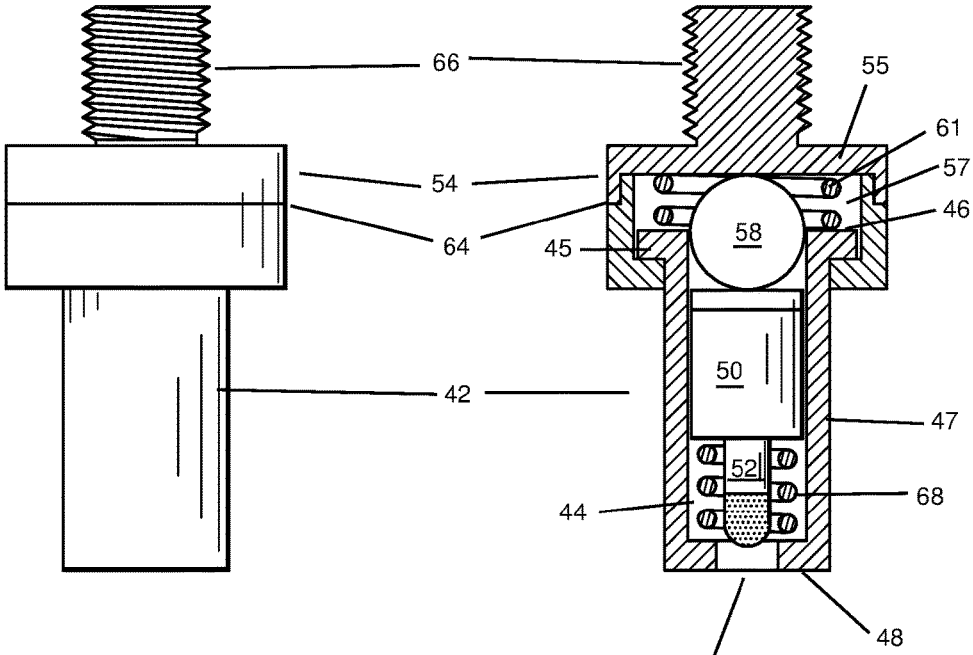
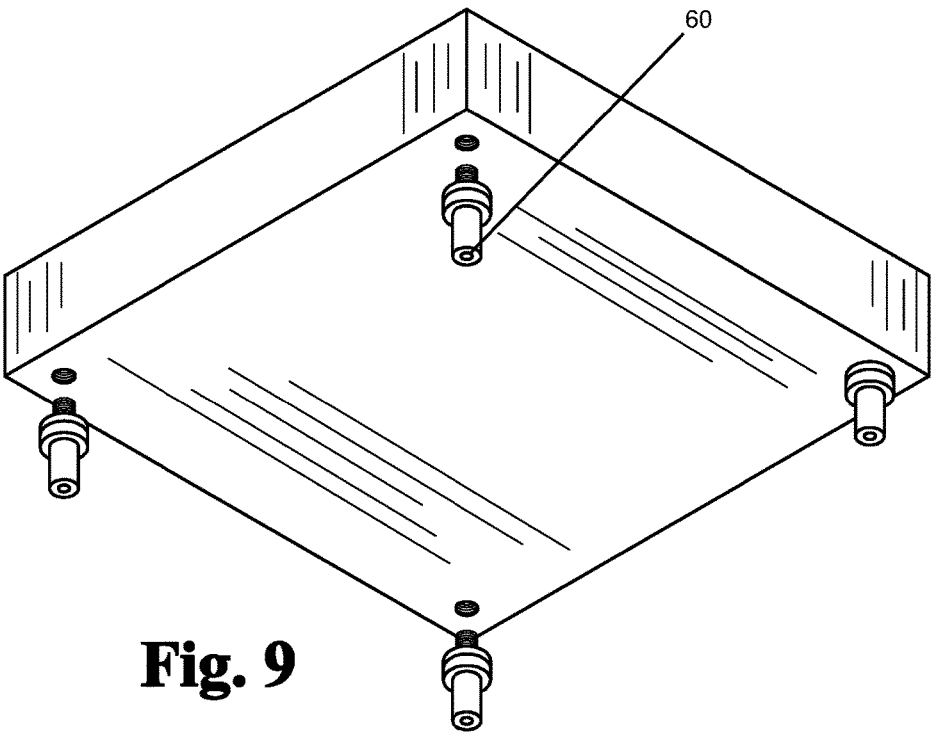
Fig. 9

PRECISION MARKING SYSTEM

CROSS-REFERENCE TO RELATED APPLICATION

This application claims the benefit of priority of U.S. provisional application No. 62/110,506, filed 31 Jan. 2015, and U.S. provisional application No. 62/110,513, filed 31 Jan. 2015, the contents of which are herein incorporated by reference.

BACKGROUND OF THE INVENTION

The present invention relates to construction tools and, more particularly, to a device for precisely marking spaced-apart points along a particular workpiece at desired and standardized intervals.

For craftsmen and artists, when marking a point on a workpiece or otherwise demarking a location for a through hole, current devices cannot repeatedly demark a plurality of visible, precise marks at predetermined intervals. Typically, the current devices or techniques require each of the plurality of desired marks to be demarked one at a time. Such sequential demarcation invites error in the form of unwanted displacement of the device and human error between marks. Moreover, current devices' "guide mechanism" for the placement of the marks is merely a hole formed in a template, and so there is nothing else for ensuring that the marks are located precisely at the center of such holes. Therefore the current devices and techniques lack useful precision.

As can be seen, there is a need for a device for precisely marking spaced-apart points along particular workpiece at desired and standardized intervals.

SUMMARY OF THE INVENTION

In one aspect of the present invention, a marking system includes a template forming a plurality of holes; at least one second pen body, wherein each second pen body extends from a distal end to a proximal end, wherein an interior compartment is provided that communicates with an aperture centered in the distal end; an ink dispenser housed in the interior compartment; and a retracting spring disposed in the interior compartment between the distal end and the ink dispenser so that the ink dispenser is biased in a retracted condition, wherein an axial force on the distal or proximal end urges the ink dispenser in an operable condition, wherein each second pen body is engaged with one of the plurality of holes so that each ink dispenser is aligned with a center of an associate hole.

In another aspect of the present invention, the marking system includes a control housing that engages the proximal end; and a threaded stud extending from the control housing in an opposite direction as the second pen body, wherein the threaded stud is dimensioned and adapted to removably secure to one of the plurality of holes.

In yet another aspect of the present invention, the marking system further includes a first pen body that engages the proximal end, wherein a periphery of the first pen body is dimensioned and adapted to snugly engage a periphery of one of the plurality of holes.

In yet another aspect of the present invention, the marking system further includes a plurality of vanes extending to the distal end, thereby forming a passageway aligning with the interior compartment; at least one second protrusion provided along an exterior of the ink dispenser; and at least one first protrusion provided by the plurality of vanes and disposed in the passageway, wherein the first and second protrusions are co-planar with each other in the operable condition but not in the retracted condition, wherein the first and second protrusions are dimensioned and adapted so that in the operable condition the plurality of vanes are radially displaced equally to engage an interior periphery of one of the plurality of holes of the template.

These and other features, aspects and advantages of the present invention will become better understood with reference to the following drawings, description and claims.

BRIEF DESCRIPTION OF THE DRAWINGS

FIG. 7 is an elevation view of an exemplary embodiment of the present invention;

FIG. 8 is a section view of an exemplary embodiment of the present invention of FIG. 7, in the retracted condition;

FIG. 9 is an exploded perspective view of an exemplary embodiment of the present invention of FIG. 7.

DETAILED DESCRIPTION OF THE INVENTION

Figure 1:
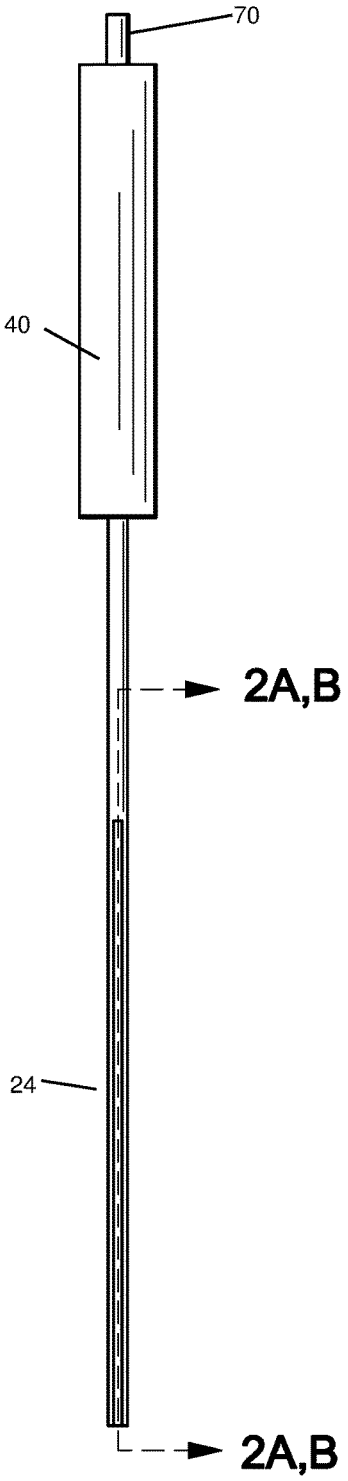
FIG. 1 is an elevation view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a precision marking system for precisely marking at least one mark. The precision marking system embodies at least one precision spot pen and a cooperating precision template, which when used together repeatedly enable the precise creation and re-creation of spaced-apart marks along a particular workpiece at desired or standardized intervals.

Referring to FIGS. 1 through 10, the present invention may include precision marking system 100 for precisely marking at least one mark wherein the precision marking system 100 embodies at least one precision spot pen 10 and a cooperating precision template 12. The precision spot pen 10 may include a first pen body 40 and a second pen body 42.

Figure 6:
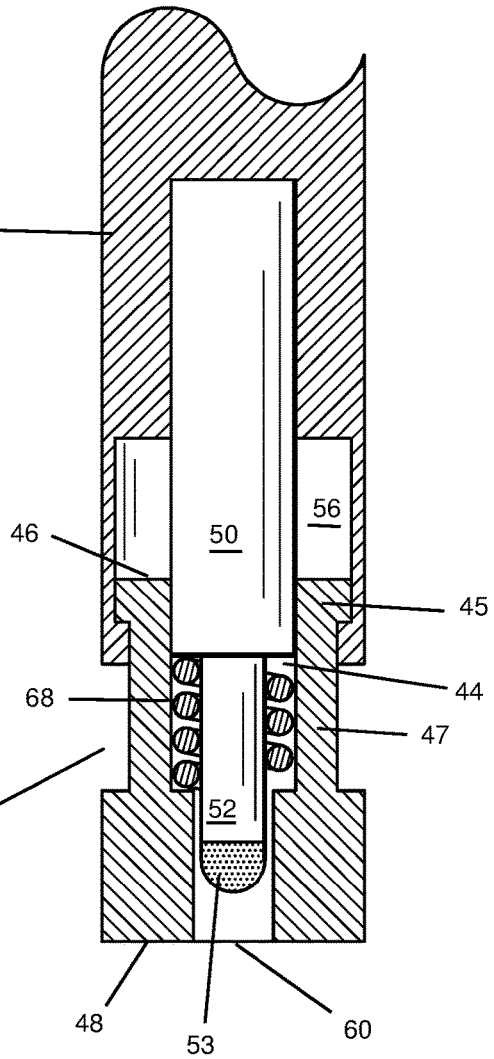
FIG. 6 is a section view of an exemplary embodiment of the present invention of FIG. 5, taken along line 6-6 of FIG. 5, in the retracted condition.

The second pen body 42 may form an interior compartment 44 extending from a proximal end 46 to a distal end 48 of the second pen body 42, as illustrated in FIGS. 6 and 8. The distal end 48 may form an aperture 60. The interior compartment 44 may be dimensioned and adapted to slidably receive and house an ink cartridge 50 and an ink dispenser 52. The ink cartridge 50 and the ink dispenser 52 may be operably joined so that the ink dispenser 52 is fluidly connected to the contents of the ink cartridge 50, wherein the ink dispenser 52 is disposed nearer to the aperture 60. The contents of the ink cartridge may be any medium sufficient to leave a controlled mark on a surface. The ink dispenser 52 may provide a delivery tip 53 adapted to deliver the medium, such as a felt tip.

In certain embodiments, the distal end 48 may have a periphery/circumference that is equal to the periphery/circumference of a central portion 47 of the second pen body 42, as illustrated in FIG. 8. In other embodiments, the distal end 48 may have a periphery/circumference that mataches the periphery/circumference of the first pen body 40, as illustrated in FIG. 6. The proximal end 46 may have a periphery/circumference that is or greater than the periphery/circumference of the central portion 47 of the second pen body 42, as illustrated in FIGS. 6 and 8, forming a flange 45.

The flange 45 of the second pen body 42 may be dimensioned and adapted to engage the inside of a control housing 54, as illustrated in FIG. 8, or the first pen body 40, as illustrated in FIG. 6. The first pen body 40 may form a body cavity 56 for slidably receiving the flange 45 and the central portion 47 or a portion thereof. In certain embodiments, the body cavity 56 may be dimensioned to receive all of both the central portion 47 and the flange 45.

The control housing 54 may provide a plurality of walls, including a rear wall 55, forming a housing space 57 housing an ink control mechanism 58, the flange 45 and a control spring 61. The control spring 61 may be disposed and sandwiched between the flange 45 and the rear wall 55, as illustrated in FIG. 8. The ink control mechanism 58 may be dimensioned and adapted to be disposed partially inside the control spring 61 and the interior compartment 44 near the proximal end 46 so that, together with the control spring 61, the ink control mechanism 58 may be adapted to center the second pen body 42 and its ink dispenser 52 relative to both the second pen body 42 and the control housing 54.

The housing space 57 may be accessible by separating two portions of the plurality of walls along a joint 64, and then enclosing the housing space 57 by reattaching the two portions along the same joint 64.

In certain embodiments, a threaded stud 66 may extend from the rear wall 55 on its surface opposing the housing space 57, as illustrated in FIG. 8. In the same embodiment, a retracting spring 68 may be disposed in the interior compartment 44 between the distal end 48 and the ink cartridge 50, circumscribing the ink dispenser 52 so that the retracting spring 68 may be adapted to bias the ink dispenser 52 in a retracted condition, where the delivery tip 53 is fully within the interior compartment 44. The retracting spring 68 may be adapted so that sufficient axial force or load imposed on the distal end 48, say by a workpiece that the second pen body 42 is being urged onto, will in turn urge the delivery tip 53 to protrude through the aperture 60, in an operable condition. Of course, the delivery tip 53 will operative engage the workpiece adjacent to the aperture 60. In an unloaded state, the second pen body 42 would be in the retracted condition, through movable between the retracted condition and the operable condition. In certain embodiments, there may be a clicking mechanism which creates a clicking sound when the present invention is moved to the retracted condition.

Figure 10:
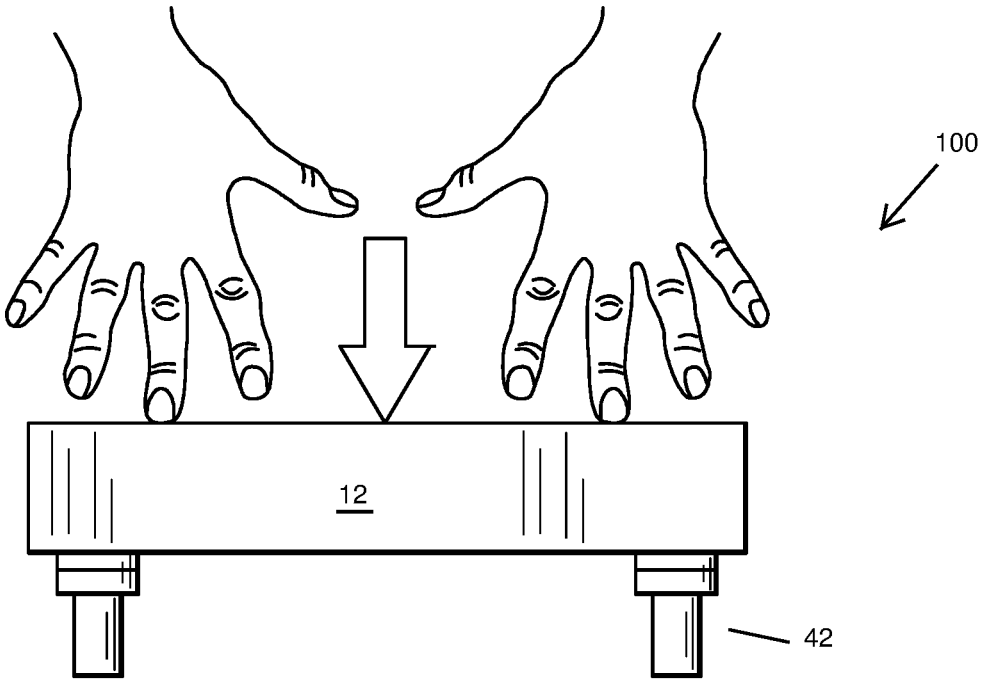
FIG. 10 is an elevation view of an exemplary embodiment of the present invention of FIG. 7, shown in use.

The threaded stud 66 may be adapted to removably engage a plurality of holes 14 provided by the template 12. Each hole 14 may provide cooperating threading. The plurality of holes 14 may be spaced-apart at desired and standardized intervals so that when at least two second pen bodies 42 are attached via the threaded stud 66, as illustrated in FIG. 8, precise points may be demarked along a workpiece by urging the template 12 onto the workpiece, which in turn urges the ink dispensers 52 to move to the operable condition, as illustrated in FIG. 10. Thereby, the medium dispensed via the ink tip 53 is at precisely the center of each engaged hole 14 of the template 12.

Figure 2A:
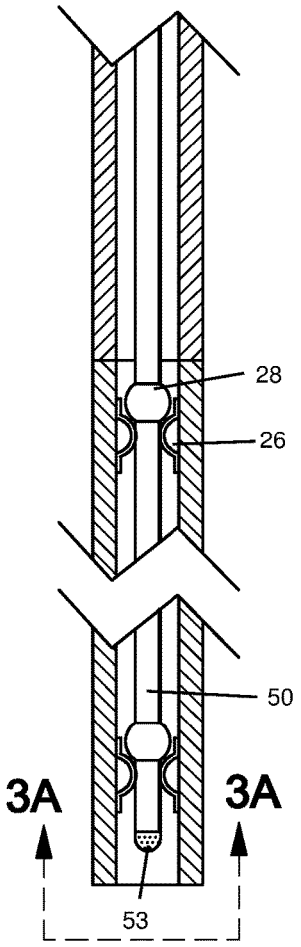
FIG. 2A is a section view of an exemplary embodiment of the present invention of FIG. 1, taken along line 2A-2A of FIG. 1, in a retracted condition.
Figure 2B:
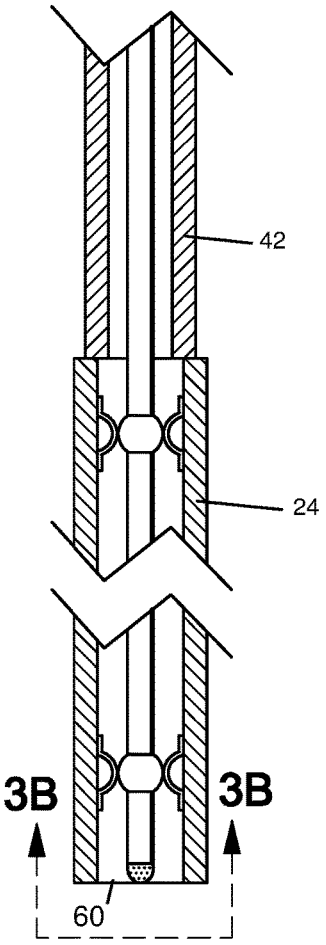
FIG. 2B is a section view of an exemplary embodiment of the present invention of FIG. 1, taken along line 2B-2B of FIG. 1, in an operable condition.
Figure 3A:
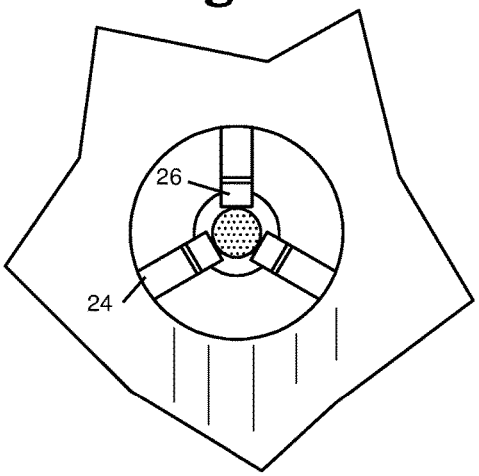
FIG. 3A is a section view of an exemplary embodiment of the present invention of FIG. 1, taken along line 3A-3A of FIG. 2A, in the retracted condition.
Figure 3B:
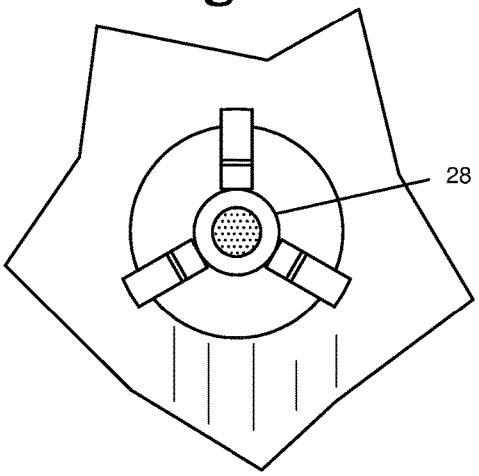
FIG. 3B is a section view of an exemplary embodiment of the present invention of FIG. 1, taken along line 3B-3B of FIG. 2B, in the operable condition.
Figure 4:
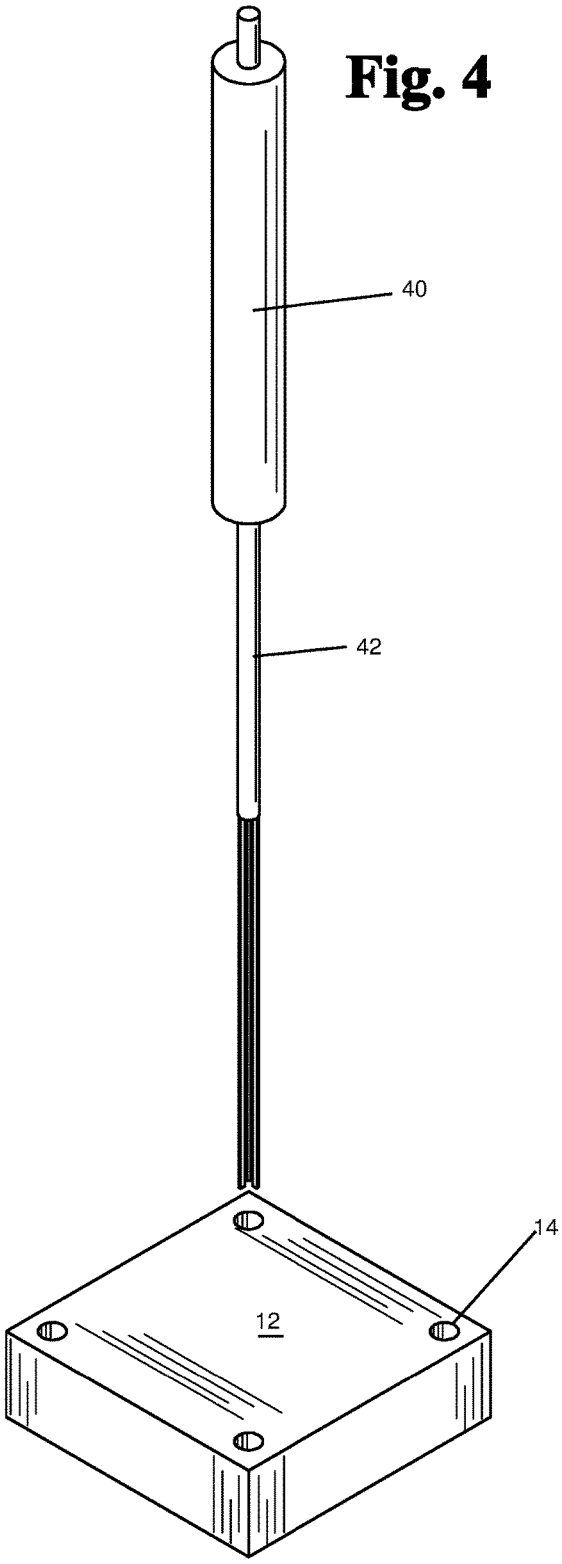
FIG. 4 is a perspective view of an exemplary embodiment of the present invention of FIG. 1.
Figure 5:
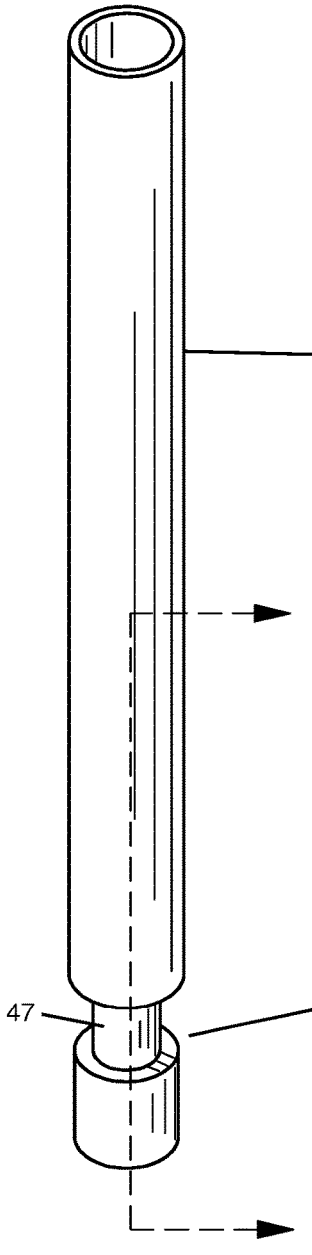
FIG. 5 is a perspective view of an exemplary embodiment of the present invention.

In an alternative embodiment, the second pen body 40 may provide a plurality of vanes 24 extending coaxially from the central portion. The plurality of vanes 24 form a passageway through which the ink dispenser 52 extends. The passageway aligns with the interior compartment 44, and the passageway terminates in the aperture 60. The plurality of vanes 24 may provide first protrusions 26 along the passageway, as illustrated in FIGS. 2A and 2B. The ink dispenser 52 may provide second protrusions 28 along an exterior thereof. In the retracted condition, the first and second protrusions 26, 28 are adjacent but not aligned/coplanar. When the ink dispenser 52 is urged relative to the vanes 24 in an axial direction, the operable condition is realized whereby the first and second protrusions 26, 28 become aligned/coplanar, which in turn urges the plurality of vanes 24 to be displaced transverse to the relative movement of the ink dispenser 52 or otherwise radially outward, as illustrated in FIG. 2B. Thus, when the plurality of vanes 24 are being slid through one of the plurality of holes 14 of the template 12 and into the operable condition, the plurality of vanes 24 displace and engage the interior of the hole 14 so that the ink dispenser 52 is precisely centered therein. The vanes 24 and the first and second protrusions 26, 28 are dimensioned and adapted so that in the operable condition, each vane 24 engages the interior wall of the associated hole 14.

A method of using the present invention may include the following. A user may provide at least one precision spot pen 10 and a cooperating precision template 12. The template 12 may be removably secured to a workpiece that the user decides to apply precise, spaced apart point demarcations. A clamp may be used to secure template 12 to workpiece. Then the user may slide the plurality of vanes 24 through a first hole so that it engages the workpiece, urging the ink dispenser 52 to the operable condition by the resulting axial force on the distal end 48, which in turn equally displaces the plurality of vanes 24 so they engage the interior of the first hole 14—precisely centering the ink dispenser 52 within the first hole. Alternatively, the precision spot pen 10 may be moved between the retracted condition and the operable condition by manipulation of a button 70. When the axial load diminishes, the vanes 24 retract to the retracted condition so that the user may remove the precision spot pen 10 and repeat the process with the other holes, thereby providing precisely spaced apart markings on the workpiece that match the template 12.

Alternatively, the user may attach at least one second body pen 42 to the holes 14 of the template via the threaded stud 66 and then compress the template 12 against the workpiece, urging the second body pen 42 into the operable condition, thus marking the workpiece accordingly. This method may allow the user to quickly apply a set arrangement of marking point a plurality of times along the workpiece.

In certain embodiments, the user may remove the flange 45 of the second body pen 42 from the control housing 54 and attach the flange 45 to the body cavity 56 of the first pen body 40. In this way, the second body pen 42 may be interchangeable between the first pen body 40 and the control housing 54. The first pen body 40 may by dimensioned and adapted to snugly slide through one of the plurality of holes 14, so that any marking point created by the ink dispenser 52 would be centered within that particular hole 14.

It should be understood, of course, that the foregoing relates to exemplary embodiments of the invention and that modifications may be made without departing from the spirit and scope of the invention as set forth in the following claims.

What is claimed is:

1. A marking system comprising:

a template forming a plurality of holes;

at least one second pen body, wherein each second pen body extends from a distal end to a proximal end, wherein an interior compartment is provided therein so as to communicate with an aperture centered in the distal end;

an ink dispenser housed in the interior compartment;

a retracting spring is disposed in the interior compartment between the distal end and the ink dispenser so that the ink dispenser is biased in a retracted condition, wherein an axial force on the distal or proximal end urges the ink dispenser in an operable condition, wherein each second pen body is engaged with one of the plurality of holes so that each ink dispenser is aligned with a center of an associate hole;

a plurality of vanes extending to the distal end, thereby forming a passageway aligning with the interior compartment;

at least one second protrusion provided along an exterior of the ink dispenser; and at least one first protrusion provided by the plurality of vanes and disposed in the passageway, wherein the first and second protrusions are co-planar with each other in the operable condition but not in the retracted condition.

2. The marking system of claim 1, further comprising:

a control housing that engages the proximal end; and a threaded stud extending from the control housing in an opposite direction as the second pen body, wherein the threaded stud is dimensioned and adapted to removably secure to one of the plurality of holes.

3. The marking system of claim 2, further comprising a control mechanism disposed between the rear wall and the ink dispenser so that the control mechanism engages an interior periphery of the interior compartment so as to align the ink dispenser and the threaded stud.

4. The marking system of claim 1, further comprising:

a first pen body that engages the proximal end, wherein a periphery of the first pen body is dimensioned and adapted to snugly engage a periphery of one of the plurality of holes.

5. The marking system of claim 4, wherein the periphery of the first pen body matches a periphery of the distal end.

6. The marking system of claim 1, wherein the first and second protrusions are dimensioned and adapted so that in the operable condition the plurality of vanes are radially displaced equally to engage an interior periphery of one of the plurality of holes of the template.

* * * * *